US005435884A

United States Patent [19]

Simmons et al.

[11] Patent Number: 5,435,884

[45] Date of Patent: Jul. 25, 1995

[54] SPRAY NOZZLE AND METHOD OF MANUFACTURING SAME

[75] Inventors: Harold C. Simmons, Ellenton, Fla.; Rex. J. Harvey, Mayfield Heights, Ohio

[73] Assignee: Parker-Hannifin Corporation, Cleveland, Ohio

[21] Appl. No.: 129,834

[22] Filed: Sep. 30, 1993

[51] Int. Cl.[6] ..... B05D 5/00

[52] U.S. Cl. ..... 216/100; 216/92; 216/48

[58] Field of Search ..... 156/634, 644, 640, 625, 156/664, 629, 633

[56] References Cited

U.S. PATENT DOCUMENTS 4,357,196 11/1982 Tanaka et al. ..... 156/644 X 4,733,823 3/1988 Waggener et al. ..... 156/644 X

*Primary Examiner*—Thi Dang

*Attorney, Agent, or Firm*—Christopher H. Morgan

[57] ABSTRACT

A method of forming an atomizing spray nozzle includes the steps of etching a swirl chamber and a spray orifice in a thin sheet of material. The swirl chamber is etched in a first side of the disk and the spray orifice is etched through a second side to the center of the swirl chamber. Feed slots are etched in the first side of the disk extending non-radially to the swirl chamber such that liquid can be conveyed to the swirl chamber so as to create and sustain the swirling motion. A inlet piece with inlet passage therein is connected with first side of the disk so as to convey liquid to the feed slots of the disk and to enclose the feed slots and swirl chamber. In addition to the method described an atomizing spray nozzle having the configuration described is much improved in its spray characteristics. The present invention also provides a method of forming a number of spray nozzles simultaneously in a single manufacturing process.

9 Claims, 3 Drawing Sheets

SPRAY NOZZLE AND METHOD OF MANUFACTURING SAME

BACKGROUND OF THE INVENTION

1. Field of the Invention

This invention relates in general to spray nozzles and methods of manufacturing same. More particularly it relates to nozzles which produce fine droplet sprays by means of liquid pressure-swift, commonly known as simplex nozzles, and the methods of manufacturing these nozzles.

2. Description of the Prior Art

The art of producing sprays by pressure-swirl is extensive. Generally these nozzles create a vortex in the liquid to be sprayed within a swirl chamber adjacent to the exit or spray orifice. Patents showing such nozzles include U.S. Pat. Nos. 4,613,079 and 4,134,606. However, it is much easier to design and manufacture relatively large spray nozzles for producing relatively larger droplet sprays than to design and manufacture relatively small nozzles to produce relatively fine droplet sprays. This is especially true in the context of manufacturing the inlet slots, swirl chambers, and exit orifices in small nozzles.

One method of characterizing nozzle size is by the dimensions of exit orifice. Small nozzle tips have exit orifices from about 0.005 to about 0.1 inches in diameter. Larger nozzles have larger exit orifice sizes. Another method is the use of "Flow Number," which relates the rate of liquid flow output to the applied inlet pressure by the equation:

$$\text{Flow Number} = \frac{\text{liquid flow rate}}{(\text{applied pressure})^{\frac{1}{2}}}$$

In industry the units used are commonly mass flow rate in pounds/hour (PPH) and the applied pressure in pounds/square inch (psi). Thus a spray nozzle which flows 10 lb./hr. at 100 psi has a Flow Number of 1.0. With a given liquid, such as aviation kerosene fuel, the Flow Number is substantially constant over a wide range of flows.

A spray nozzle having a Flow Number of 1.0 typically requires a swirl chamber diameter of 0.075 inch, and exit orifice of 0.012 inch diameter and 2 inlet slots 0.020 inch square or 4 inlet slots 0.014 square. This represents the lower limit of dimensions which can be produced by conventional machining methods. There is a need for spray nozzles with Flow Numbers less than 1.0 down to 0.1, which require even smaller dimensions.

In manufacturing the openings and surfaces of small nozzles it is often necessary to use precision jeweler's tools and microscopes. To manufacture many of these features has heretofore only been possible using relatively low volume machine tool and hand tool operations in connection with high magnification manipulation and examination techniques. This is therefore a labor intensive process with a high rejection or scrap rate. The accuracy with which the dimensions of a nozzle of Flow Number 1.0 can be made limits the consistency of performance of supposedly identical nozzles. For example, if the exit orifice is nominally 0.010 inch diameter, an inaccuracy of only 0.0005 inch (which is about the best that can be achieved by typical manufacturing techniques) will result in a variation in flow rate of 10% from the nominal. Some applications of spray nozzles (e.g., aircraft gas turbine engines) require flow rates to be held within limits of ±2%. There is clearly a need for improved methods of manufacture which will give greater accuracy.

Another factor of considerable importance is the need to obtain concentricity of the exit orifice with the swirl chamber and also to place the inlet slots symmetrically relative to the axis of the swirl chamber. This involves the problem of maintaining invariable positioning of the tools and the workpiece, which introduces another set of tolerances or potential inaccuracies. It should be noted also that in the nozzle configuration shown in FIGS. 1 and 2, representing prior art, it is impossible to machine the inlet sots such that they are truly tangential to the outer edge of the swirl chamber.

It is well known that creating a vortex or swift in the liquid to be sprayed from an exit orifice produces finer droplet sizes than would result from a simple jet. This results from the turbulence and tangential shearing forces placed on the thin film of liquid by its swirling motion as it exits the nozzle exit orifice. Generally, faster swirling results in finer droplets.

Finer droplet sizes are desired in a wide range of spray applications. For example, in sprays used in the combustion of fuels, fine droplet sizes improve the efficiency of combustion and reduce the production of undesirable air pollutants.

Another advantage of improved efficiency in droplet formation is that lower pressurization of the liquid can produce the desired size of droplets. In a combustion engine, this allows a lower pressurization of the fuel to result in a spray which is ignitable. This provides many advantages in, for example, an aviation gas turbine engine which uses spray nozzles for combustion of aviation kerosene and which is required to be as simple and light as possible.

Referring now to FIGS. 1 and 2, a spray nozzle 11 constructed in accordance with the prior art is shown. The nozzle 11 is a relatively small nozzle having an exit or spray orifice diameter of approximately 0.020 inches. The spray orifice 13 and the nozzle 11 are of a type suitable for use in an aircraft gas turbine engine. The liquid sprayed by this nozzle would typically be aviation kerosene.

The spray orifice 13 is formed in the cone shaped end 15 of a nozzle housing 17. The interior 19 of the housing 17 is generally cylindrically shaped and has a conical opening 21 which terminates at the spray orifice 13. Retained within the conical opening 21 by a spring 23 is a swirl piece 25.

The swirl piece 25 has an annular wall 27 at its upper end which defines a cylindrical swirl chamber 29 therein. The annular wall 27 contacts the surface of the conical opening 21 so as to form an exit cone 31 between the swirl chamber cavity 29 and the spray orifice 13. The inlets to the swirl chamber 29 are shown through 4 slots 33, 34, 35, and 36 in the annular wall 27 although more or fewer slots can be used. These slots 33, 34, 35 and 36 are directed so that the liquid flowing into the swirl chamber cavity 29 will move in a swirling motion as shown by the arrows 37, 38, 39, and 40 in FIG. 2. Fluid exits the swirl chamber through the exit cone 31 and, in turn, the spray orifice 13.

The liquid proceeds as shown by flow arrows 28 into an annular area 26 formed by the interior 19, the conical opening 21, and the swirl piece 25 by flowing through, in this example, three flats 20, 22, and 24 cut on the swirl piece 25. The liquid is then free to flow through the inlet slots 33, 34, 35, and 36 and into the swirl chamber 29 in such a manner as to create a vortex in said swirl chamber 29.

In order to manufacture the prior art nozzle shown in FIGS. 1 and 2 it is necessary to use very small size cutting and forming tools. Even with very small tools, it is very difficult to accurately form the nozzle and its pieces. For example, it is very difficult to cut the spray orifice 13 both because of the small size of the orifice and because of the need to precisely center the orifice at the tip of the conical opening 21.

It is also difficult to manufacture the swirl piece 25, especially its annular wall 27 and the slots 33, 34, 35 and 36. The annular wall 27 must precisely meet and seal at the edge which contacts the conical opening 21. This may require mate lapping of both surfaces. The slots 33, 34, 35 and 36 require very delicate tools and often hand working under microscopes in order to form them with correct size and position and also to remove burrs which could disrupt flow.

It is therefore an object of the present invention to provide a spray nozzle which is more efficient in its performance and is easier to manufacture. It is also an object of the present invention to provide a configuration and method of manufacture for such nozzles which are especially suited for pressure-swirl nozzles of low Flow Numbers.

SUMMARY OF THE INVENTION

In accordance with these and other objects, the present invention includes an atomizing spray nozzle which comprises a relatively thin section of a hard, strong, etchable structural material such as metal. A swift chamber and an exit orifice are formed in this thin section of material. The swirl chamber is bowl shaped and is formed in a first side of the thin section of material. A second side of the thin section of material has an exit orifice extending therethrough to the center of the swirl chamber. The configuration of the swirl chamber and exit orifice are such that fluid to be sprayed from the nozzle can move in a free vortex motion in the swirl chamber and then exit the exit orifice to form an atomized spray. The first side of the thin section of material also has therein at least one feed slot extending non-radially into the swift chamber. These slots serve as the liquid inlet to the swift chamber and produce a swirling motion of the liquid in the swirl chamber.

Each of the orifice, swift chamber, and feed slots have a rounded shape characteristic of etching. This smooth, fluid shape is ideal for conveying liquid, efficiently producing a vortex in the bowl-shaped swirl chamber, and producing an atomized spray as the liquid exits the exit orifice. The exit orifice shape produced by etching can have a desirably low length to diameter ratio. This also provides improved atomization.

The first side of the thin section of material can also have a feed annulus formed therein which extends around the swirl chamber and which is in liquid communication with each of the feed slots and the feed conduit. The feed annulus can thus more evenly distribute the flow to each of the feed slots and improve the uniformity of the atomized spray.

The nozzle further comprises a member to mate with the first side of the thin section of material and thus convert the feed annulus, feed slots and swirl chamber into closed passages. This member can also function as a support which can have a feed conduit therein to convey liquid through the support to the feed slots.

The thin section of material preferably comprises a disk formed of stainless steel. This material can be formed in desirably small disks and is appropriate for etching in the form described. It is hard enough to provide a long service life and is resistant to corrosion in a combustion environment.

The present invention also provides an improved method of manufacturing an atomizing spray nozzle. This method includes the steps of etching a swift chamber in a portion of the nozzle. The etched swirl chamber has a shape such that liquid to be sprayed can move therein in a vortex motion toward the center of the swirl chamber. This method also includes etching a spray orifice which extends through the center of the swirl chamber such that fluid to be sprayed can move from the swirl chamber to the spray orifice and then exit the spray orifice in a conically shaped thin film which soon atomizes into a fine droplet spray.

This method can also include the step of etching one or more feed slots which extend non-radially into the swirl chamber. The slots are etched to form passages for feeding liquid to the swirl chamber in such a way as to create a swirling motion.

The etching steps are preferably performed in a thin section of an etchable, hard, strong material. The shape of the etched portion of the nozzle is preferably a thin disk with a first side and a second side. The steps of etching the swirl chamber and the feed slots can comprise etching them into the first side and the step of etching the spray orifice comprises etching the orifice through the second side to the swirl chamber. These two steps can preferably be accomplished simultaneously.

This method also comprises forming an inlet and/or a support which can mate with the disk. A feed conduit is formed in the support for conveying liquid to be sprayed to the feed slots of the disk. The first side of the disk is sealingly connected to the inlet or support to enclose the feed slots and swirl chamber and to connect the feed conduit to the feed slots.

This method can also include forming a feed annulus on the first side of the disk adjacent the periphery of the disk. This annulus has a configuration which surrounds the swirl chamber and which connects the feed slots to the feed conduit of the support for conveying liquid therebetween.

The present invention also provides a method for forming a plurality of atomizing spray nozzles. This method includes etching a plurality of the etched nozzles having the etched swirl chambers and spray orifices as described above in a thin section of material and then dividing the thin section of material into separate spray nozzles each of which has one of the swift chambers and spray orifices therein. This method can include etching a separation slot in the thin section for easily dividing the separate spray nozzles. The separation slot extends through the thin section of material around each spray nozzle except for one or more relatively thin support bridges.

The steps of etching the feed slots, the feed annulus, and other feed passages can be performed simultaneously in the method of forming the plurality of spray nozzles in the thin section of material.

For a further understanding of the invention and further objects, features and advantages thereof, reference may now be had to the following description taken in conjunction with the accompanying drawings.

DESCRIPTION OF PREFERRED EMBODIMENTS

Figure 1:
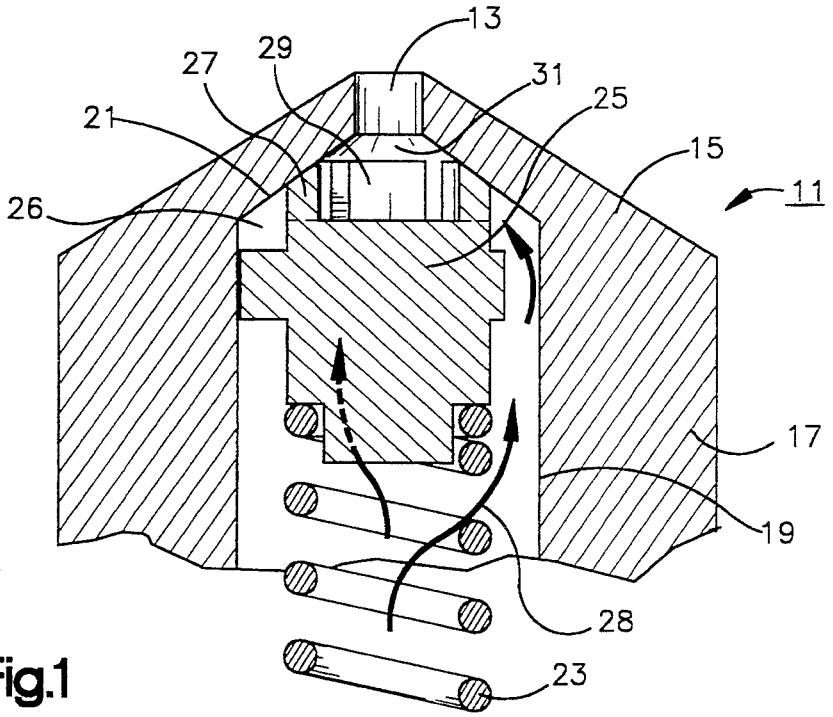
Fig.1 (PRIOR ART)
FIG. 1 is a cross-sectional view of a prior art nozzle.
Figure 2:
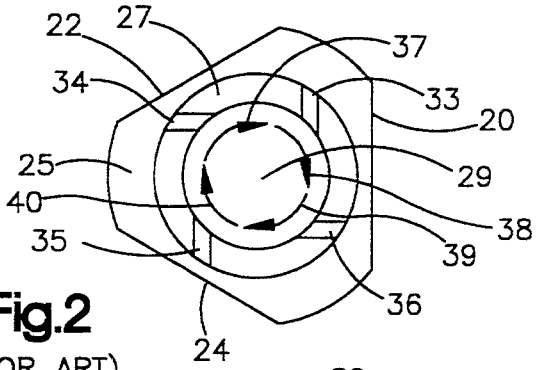
Fig.2 (PRIOR ART)
FIG. 2 is a plan view of a piece of the prior art nozzle shown in FIG. 1.
Figure 3:
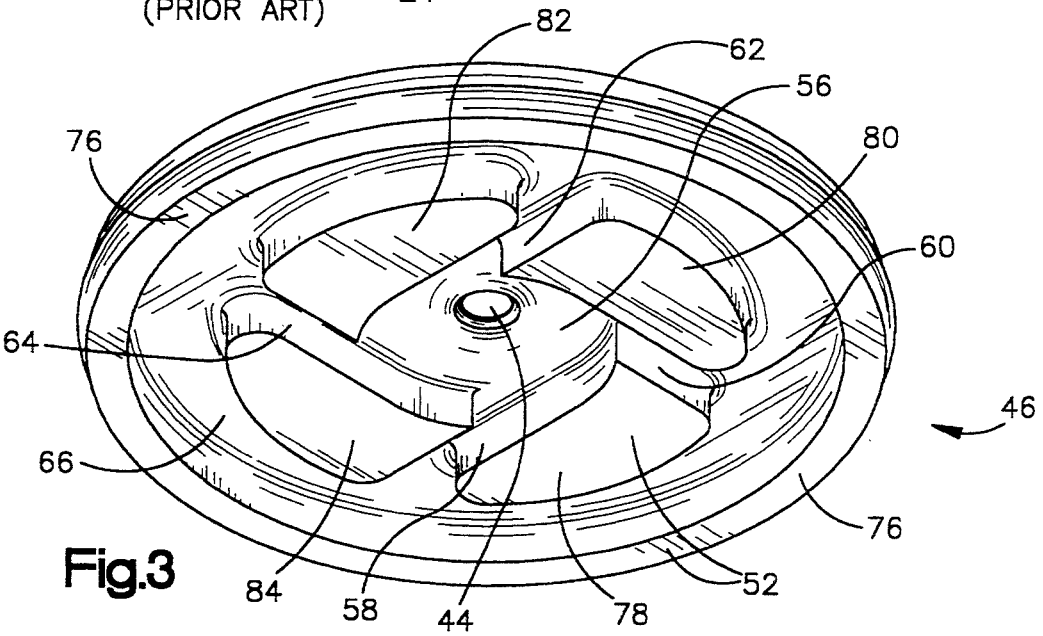
FIG. 3 is a perspective view of a portion of a nozzle constructed in accordance with the present invention.
Figure 4:
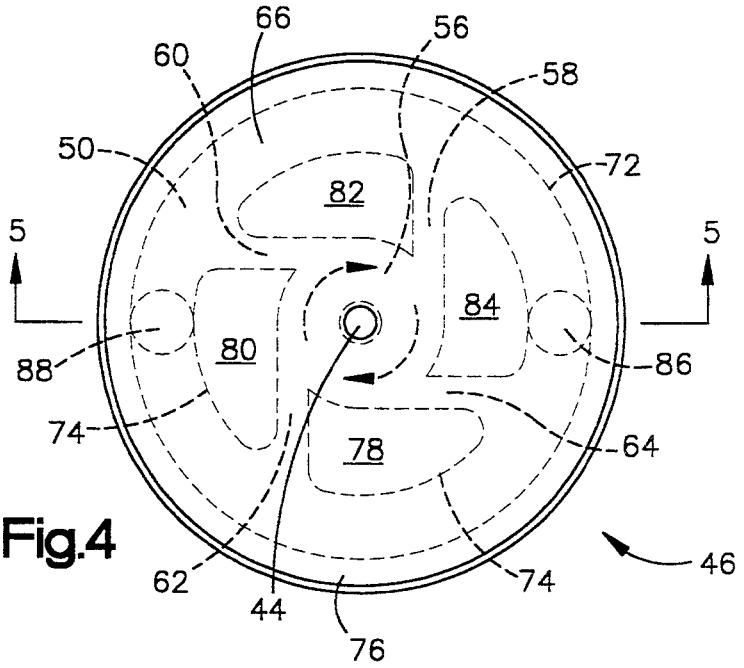
FIG. 4 is a top view of a nozzle constructed in accordance with the present invention.
Figure 5:
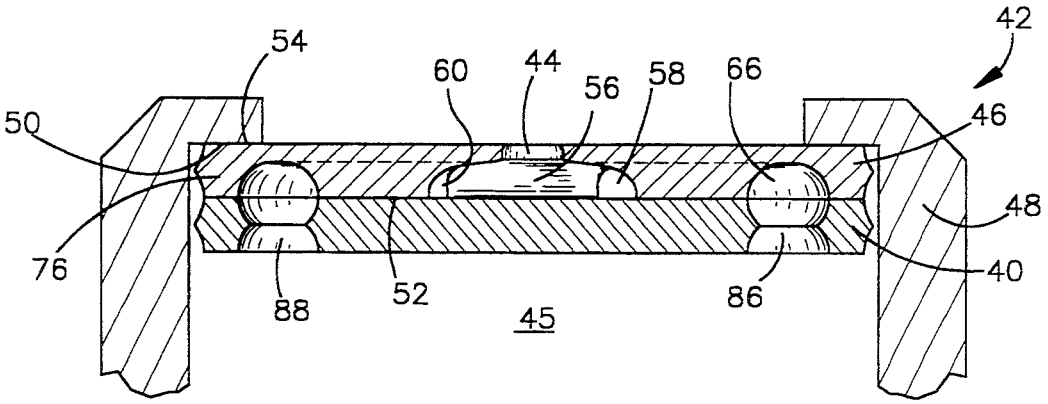
FIG. 5 is a cross-sectional view of the nozzle shown in FIG. 4 taken along the lines shown in FIG. 4.
Figure 6:
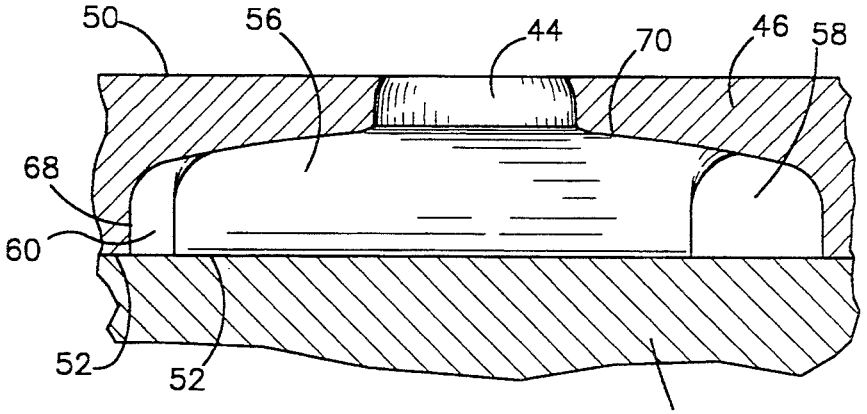
FIG. 6 is an enlarged cross-sectional view of a portion of the nozzle shown in FIG. 5 taken along the same lines as FIG. 5.

Referring now to FIGS. 3 through 6, a nozzle 42 formed in accordance with the present invention is shown. Like the prior art nozzle 11 shown in FIGS. 1 and 2, the nozzle 42 is a relatively small nozzle. An example use for such a small nozzle is a spray nozzle in an aviation gas turbine engine. Other applications for which this nozzle is especially suited include other liquid hydrocarbon burners. The nozzle 42 has a spray orifice 44 with a diameter of approximately 0.017 inches.

The nozzle 42 includes a disk 46, an inlet piece 40, and a disk support 48. The disk 46 has an upper flat surface side 50 and a lower flat surface side 52. The support 48 is usually circular but can be of any shape with a flat surface 54 which mates with the flat surface side 50 of the disk 46. The diameter of the disk 46 is approximately the same as the internal diameter of the support 48. Together the disk 46, the inlet piece 40, and the support 48 form a cylindrical nozzle with the spray orifice 44 at the upper center of the cylindrical nozzle assembly.

Formed in the lower side 52 of the disk 46 is a swirl chamber 56, inlet slots 58–64 and a feed annulus 66. As described in more detail below, these voids or cavities, together with the spray orifice 44 can be formed in the disk by etching. Etching allows these voids or cavities to have uniformly rounded edges with no burrs which is conducive to efficient liquid flow.

The swirl chamber 56 has a bowl shape and is formed in the center of the disk 46. By bowl shape it is meant that chamber is round, and the sides of the chamber are gently curving with an approximately vertical outer wall 68 and an approximately horizontal inner wall 70. Spray orifice 44 extends through the upper flat surface 50 of the disk 46 to the center of the swirl chamber 56.

The swirl chamber 56 is approximately 0.060 inches in diameter at its widest point. It is approximately 0.013 inches in depth at its deepest point. The size and shape of the swift chamber are determined in part by the size of the spray nozzle. Preferably, the ratio of the diameter of the swirl chamber are determined in part by the size is in the range of approximately 2/1 to approximately 10/1. This ratio in large part determines the acceleration of the fluid as it moves toward the spray orifice 44. However, to keep friction low it is preferable that this ratio be in the range of approximately 2/1 to approximately 5/1.

The dimensions of the spray orifice 44 are also important to spray efficiency. The length of the spray orifice 44 (the distance from the inner wall 70 at the orifice to the surface 50 at the orifice) is approximately 0.006 inches. Thus the ratio of the length to diameter of the orifice 44 is approximately $\frac{1}{3}$. Smaller length to diameter ratios improve the efficiency of the spray by reducing friction losses. The configuration of the swift chamber and spray orifice in the present invention allow a small length to diameter orifice ratio to be achieved.

Preferably the diameter of the spray orifice 44 is in the range of approximately 0.002 to approximately 0.100 inches. This size range is suitable for the nozzle configuration of the present invention and the techniques of etching.

To initiate the swirling flow in the swirl chamber 56, the inlet slots 58, 60, 62, and 64 are formed in the disk so as to extend non-radially from the swirl chamber. Of course, each extends in the same rotational direction so as to initiate swirling in the same direction in the swirl chamber. In some applications it might be desired to have the inlet slots 58, 60, 62, and 64 extend in directions which are not tangential but which are still non-radial so as to produce a lesser swirling motion of the liquid in the swirl chamber 56. For example, it might be desired to reduce the speed of swirling to decrease the spray angle.

The slots 58–64 are also formed by etching and therefore have a trough shape with rounded walls. This rounded shape is preferred for efficiency of fluid flow in conveying fluid to the swirl chamber 56. In addition, this shape blends with the rounded walls of the swirl chamber to provide efficiency of liquid flow in the transition between the slots 58–64 and the swirl chamber 56.

Surrounding the swirl chamber 56 and slots 58–64 is the feed annulus 66. The feed annulus 66 has a circular exterior wall 72 and a circular interior wall 74 interrupted by the slots 58–64. Each of the circular walls 72 and 74 as well as the feed annulus 66 preferably has the same center or axis as the orifice 44 and the swirl chamber 56.

As with the slots 58–64, the annulus 66 has a trough shape with rounded walls. It has approximately the same depth as the slots 58–64 and the portion of the swift chamber 56 adjacent the slots. It is, of course, not necessary to the function of the annulus to have it extend in an entire circle. It could be in the form of an interrupted annulus or any other feed passage shape.

Prior to etching, the disk 46 has a flat lower surface 52, portions of which remain after the etching. These portions include a peripheral annular wall 76 and four island surfaces 78, 80, 82, and 84. The annular wall 76 surrounds the annulus 66. The island surfaces 78–84 lie between the swirl chamber 56, the slots 58–64, and the feed annulus 66. These surfaces are sealingly connected to the inlet piece 40 so as to sealingly contain the liquid flow as it flows from the annulus 66 to the slots 58–64 to the swirl chamber 56.

The inlet piece 40 is a flat disk with one or more inlet passages 86 and 88 extending therethrough. The inlet passages 86 and 88 connect to the feed annulus 66. They allow a flow of liquid through the inlet piece 40 to the feed annulus 66 which, in turn, allows flow to the slots 58–64.

The support 48 has an interior passage 45 leading to the inlet piece 40. This interior passage 45 connects to the inlet passages 86 and 88. Through this interior passage 45, liquid can be supplied to the nozzle 42.

It is, of course, possible to form the support 48 in many shapes other than a cylinder. Shapes which serve other functions of the nozzle or other purposes are possible since the only required functions of the support are to convey liquid to the inlet 40 and the disk 46 and to sealingly connect to the same.

The support 48 can be connected to the disk 46 by high temperature brazing. This allows the flat surface 50 to be connected to the flat surface 54 so as to seal the fluid passages in the nozzle 42. Conventional brazing materials and techniques such as paste or foil brazing or nickel plate brazing can be used to make this connection. It is also possible to connect the disk 46 to the support 48 by a mechanical connection or by welding or other means.

The disk 46 is preferably formed of a strong, hard, erosion resistant, etchable material. Such materials include metals, ceramics, polymers, and composites. A preferred metal is stainless steel. Stainless steel is corrosion resistant and is readily etchable. 440 C Stainless is a very hard stainless steel suitable for the disk 46 and the inlet piece 40.

The present invention provides a much improved method of manufacturing the nozzle 42 in addition to the improved nozzle performance described above. This improved method comprises manufacturing the nozzle by etching instead of conventional machining or cutting tools. This method is possible because of the unique configuration of the nozzle and the unique configuration of the nozzle is possible because of the method of manufacture.

Using this method and nozzle configuration it is possible to form nozzles with an improved flow number. Nozzles constructed in accordance with the present invention can have flow numbers at least as low as 0.1 (pound/hour)/(pounds/square inch)$^{\frac{1}{2}}$. *Nozzles constructed in accordance with the present invention preferably have flow numbers in the range of from about* 0.1 to about 50 (pound/hour)/(pounds/square inch)$^{\frac{1}{2}}$.

The improved method of manufacturing the nozzle 42 comprises manufacturing the swirl chamber 56 and the spray orifice 44 by etching each of them in a portion of the nozzle. The shape and location of the swirl chamber 56 and the orifice 44 are described above. In addition, the method can include etching the slots 58–64 and the feed annulus 66, as well as any other desired passages.

While the above configuration shows the swirl chamber on one side of a disk and the exit orifice extending through the other side of the disk, it is possible to etch the swirl chamber in a first piece and the orifice in another piece. Although it is considered that this nozzle configuration would be somewhat less efficient in forming an atomized spray, the method of forming the nozzle is still much improved over the metal cutting manufacturing techniques of the prior art.

The process of etching by chemical or electro-chemical or other techniques is well known. An example of a suitable etching process for stainless steel is chemical etching by means of photo-sensitive resist and ferric chloride etchant. The following example describes such an etching process.

Two thin, opaque stencils are made of the two dimensional shapes that are desired on both sides of the final product. Cutouts are made where etching is to occur. These stencils can be initially shaped many times oversize so that very fine detail and great accuracy can be built into the shapes. These cutouts are sized to allow for the etchant undercutting the resist masking and making the size of the etched feature larger.

A polymer (or glass) production mask is then produced by photographically reducing the stencil to the actual size of the part and photographically duplicating it in as many places as is desired on the mask. This makes a "negative" of the desired shape; that is, it is opaque where the etching is to occur. This process precisely duplicates the design shape and places it in precise locations on the mask sheets. The front and back masks are very carefully optically aligned and fastened together along one edge. Another method of producing these masks is through computer aided drafting and precision laser plotting.

A very flat and very smooth metal sheet is carefully cleaned. Sometimes, as part of this cleaning, it is "pre-etched"; that is, it is put in the etching chamber and the etchant is sprayed on both sides of the sheet for a very short time to clean any contaminant from the surface by etching away a small amount of the surface of the sheet. This improves the adhesion of the photo-sensitive resist in two ways, one by providing a cleaner surface and the other by providing a "tacky" surface of sharp grains and undercut grain boundaries. The "smeared" metal at the surface of the rolled sheet is thus removed.

A thin layer of photo-sensitive resist material is now applied to both surfaces of the metal sheet. This is usually done in one of two manners. The metal can be dipped into a liquid photo-sensitive resist which is then carefully dried. Or, a thin photo-sensitive plastic film can be roll bonded onto both sides of the metal sheet. The liquid has the advantage of being very thin and the film has the advantage of being very uniform.

This metal sheet, with photo-sensitive resist now on both surfaces, is put between the two carefully aligned sheets of the mask and the whole sandwich is held together very tightly by use of a vacuum frame which sucks a transparent sheet down on top of the stack and holds it, very rigidly, in place. A strong light is now directed at the top and bottom of the sandwich. This light activates (solidifies) the photo-sensitive resist where it strikes it by passing through the transparent portions of the mask. The opaque parts of the mask (where etching is to occur) stop the light from penetrating and therefore, the photoresist is not activated.

The sheet is then removed from the mask and dipped in a suitable solvent to remove all of the photoresist that was not solidified by the light. This exposes the bare surface of the metal in those areas that are to be etched. Those areas that are not to be etched are left covered by the solidified photo-sensitive resist material.

The sheet is then put in the etching chamber and the etchant is sprayed evenly on both surfaces (top and bottom) at once. The sheet is removed periodically and examined to see how far the etching has progressed. This is usually done by measuring the diameter of holes that pass entirely through the metal sheet. The etch is stopped when these holes reach the desired diameter. Or, if desired, the parts can be designed to drop out of the parent sheet when they are finished. Each time the sheet is removed from the chamber, it is turned slightly so that the etching process is as even as possible over the entire surface of the sheet. The etchant usually used for common materials such as 400 series stainless steel is primarily ferric chloride. It is relatively harmless, even to exposed skin.

Figure 7:
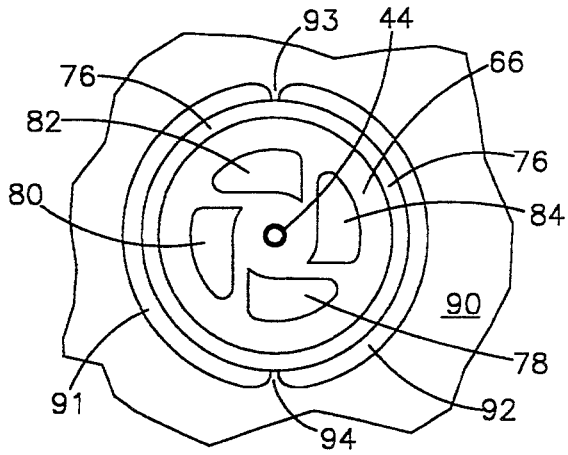
FIG. 7 is a detail plan view of a single nozzle formed in a thin sheet of material by the method of the present invention.

When the etching is finished, the solidified photo-sensitive resist is removed from the surface of the metal by scrubbing with another solvent. It is to be understood that the preceding description of the manufacturing process can apply to a single nozzle or a number of nozzles produced simultaneously from a single sheet. The sheet will typically be of rectangular shape for ease of fabrication and handling and larger, of course, than the disc of the nozzle as shown in FIG. 7. To aid removal of the disc 46 from the sheet 90, separation slots 91 and 92 are etched through the sheet to form a complete circle except for small bridges 93 and 94 which can be easily broken.

Figure 8:
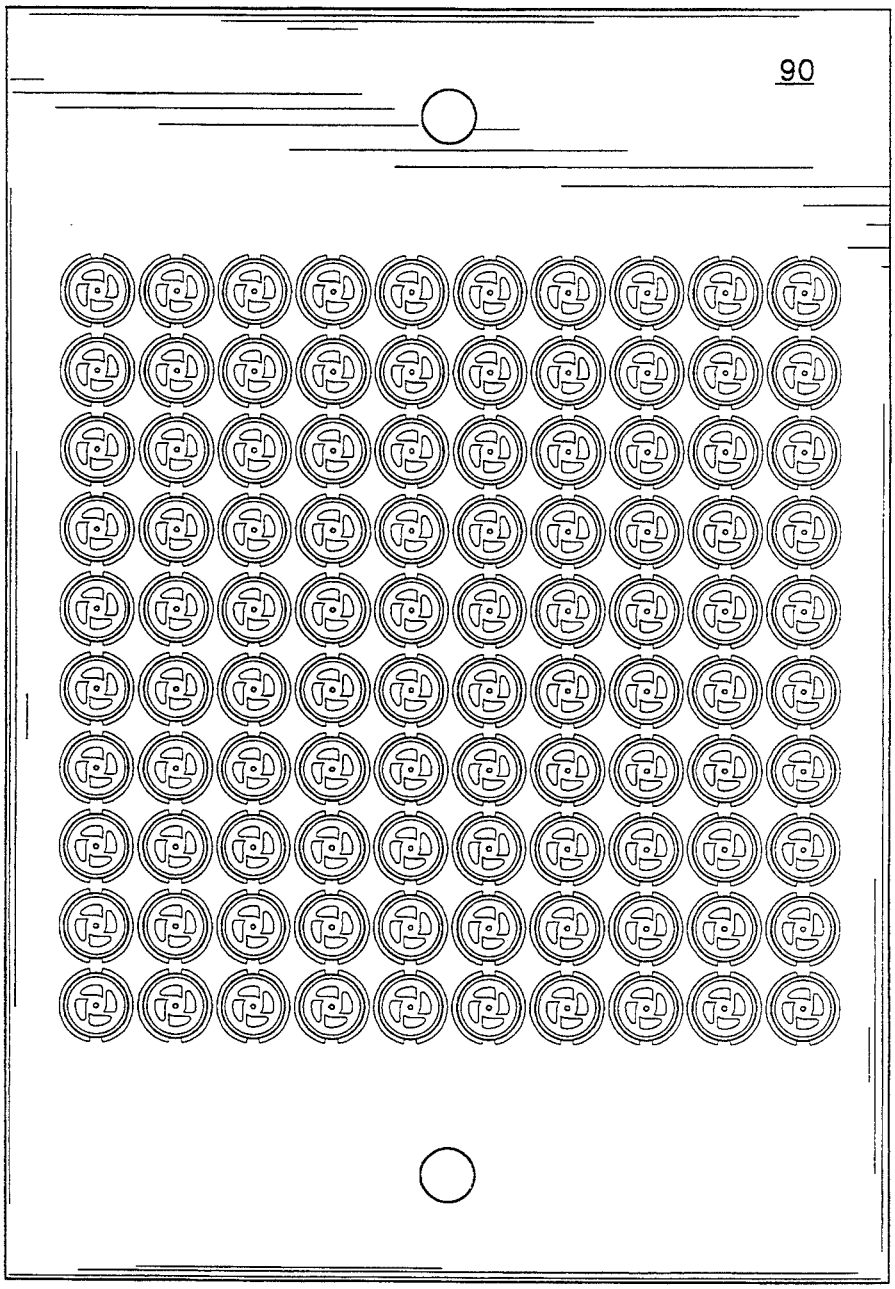
FIG. 8 is a plan view of a plurality of nozzles formed in a thin sheet of material by the method of the present invention.

FIG. 8 shows a large number of nozzles etched simultaneously in a single sheet. It will be understood that the photographic method of producing the masks for the etching process insures that the nozzles will be identical in dimensions, edge breaks, and surface finish. It has been found that 100 or more nozzles can be manufactured simultaneously by the said process.

The figures described show how many nozzles meant for individual use can be made simultaneously. These multiple nozzles could, of course, be used simultaneously as a nozzle array by leaving them in place on the sheet and providing passages to each of the nozzles either in the sheets or in the inlets or supports.

Thus, the present invention is well adapted to achieve the objects and advantages mentioned as well as those inherent therein. It will be appreciated that the end specification and claims are set forth by way of illustration and not of limitation, and that various changes and modifications may be made without departing from the spirit and scope of the present invention.

What is claimed is:

1. A method of forming an atomizing spray nozzle comprising the steps of:

etching a swirl chamber in a thin section of material, said swirl chamber having a shape such that liquid to be sprayed can move therein in a vortex motion toward the center of the swirl chamber; and etching a spray orifice which extends through the thin section of material at the center of the swirl chamber such that liquid to be sprayed can move from said swirl chamber to said spray orifice and then exit the spray orifice in a conically shaped thin film which soon atomizes into a fine droplet mist.

2. The method of claim 1 which further comprises the step of:

etching in said thin section of material at least one feed slot which extends non-radially to said swirl chamber.

3. The method of claim 2 wherein said thin section of material has a first side and a second side and wherein said step of etching said swirl chamber comprises etching in said first side of said thin section of material a bowl-shaped swirl chamber cavity.

4. The method of claim 3 wherein said step of etching said spray orifice comprises etching an orifice through said second side of said thin section of material to said swirl chamber.

5. The method of claim 4 which further comprises the steps of:

forming an inlet piece which can mate with said thin section of material;

forming an inlet passage in said nozzle for conveying liquid to be sprayed to said at least one feed slot; and sealingly connecting said first side of said thin section of material to said inlet piece and connecting said inlet passage to said at least one feed slot.

6. The method of claim 5 wherein said thin section of material comprises a disk and further comprises the step of etching a feed annulus on said first side of said disk adjacent the periphery of said disk of such configuration as to be connected to said at least one feed slot of said disk and said inlet passage of said inlet piece for conveying liquid therebetween.

7. A method of forming a plurality of atomizing spray nozzles comprising the steps of:

etching a plurality of spaced apart swirl chambers in a thin section of metal, said swirl chambers having a shape such that liquid to be sprayed can move in each-swirl chamber in a vortex motion toward the center of the swirl chamber;

etching a spray orifice which extends through the thin section of metal at the center of each of said plurality of swirl chambers such that liquid to be sprayed can move from each swirl chamber to said spray orifice and then exit the spray orifice in an active thin film; and dividing said thin section of metal into separate spray nozzles each of which has one of said swirl chambers and orifices therein.

8. The method of claim 7 wherein said step of dividing said thin section of metal into separate spray nozzles comprises:

etching a separation slot which extends through said thin section of metal and around each spray nozzle except for one or more relatively thin support bridges.

9. The method of claim 7 which further comprises the step of:

etching in said thin section of metal one or more feed slots which extend non-radially from each swift chamber.

* * * * *

UNITED STATES PATENT AND TRADEMARK OFFICE

CERTIFICATE OF CORRECTION

PATENT NO. : 5,435,884

DATED : July 25, 1995

INVENTOR(S) : Harold C. Simmons and Rex J. Harvey

It is certified that error appears in the above-indentified patent and that said Letters Patent is hereby corrected as shown below:

Column 5, Line 64, delete "are determined in part by the size", and insert therefore -- to the diameter of the spray orifice--.

Column 5, Line 62, delete "swift" and insert therefore --"swirl".

Column 6, Line 10, delete "swift" and insert therefore --"swirl".

Signed and Sealed this

Eighth Day of July, 1997

Bruce Lehman

*Attest:*

BRUCE LEHMAN

*Attesting Officer*

*Commissioner of Patents and Trademarks*